US012161193B2

(12) United States Patent
Kuerbis et al.

(10) Patent No.: US 12,161,193 B2
(45) Date of Patent: Dec. 10, 2024

(54) MIDFOOT SUPPORT STRUCTURES FOR ARTICLES OF FOOTWEAR

(71) Applicant: NIKE, Inc., Beaverton, OR (US)

(72) Inventors: Tate E. Kuerbis, Portland, OR (US); Ross Klein, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 120 days.

(21) Appl. No.: 17/404,664

(22) Filed: Aug. 17, 2021

(65) Prior Publication Data

US 2022/0053885 A1 Feb. 24, 2022

Related U.S. Application Data

(60) Provisional application No. 63/068,540, filed on Aug. 21, 2020.

(51) Int. Cl.

| | |
|---|---|
| ***A43B 23/22*** | (2006.01) |
| ***A43B 13/12*** | (2006.01) |
| ***A43B 13/18*** | (2006.01) |
| ***A43B 13/20*** | (2006.01) |

(52) U.S. Cl.

CPC ..... *A43B 23/222* (2013.01); *A43B 13/125* (2013.01); *A43B 13/186* (2013.01); *A43B 13/20* (2013.01); *A43B 13/187* (2013.01)

(58) Field of Classification Search

CPC ..... A43B 13/125; A43B 13/187; A43B 13/12; A43B 31/181; A43B 13/141; A43B 13/183; A43B 13/185; A43B 7/142

USPC ..... 36/107, 108

See application file for complete search history.

(56) References Cited

U.S. PATENT DOCUMENTS

| | | | | |
|---|---|---|---|---|
| 5,729,916 | A * | 3/1998 | Vorobiev | A43B 13/183 36/38 |
| 6,401,366 | B2 * | 6/2002 | Foxen | A43B 7/1495 36/102 |
| 9,687,042 | B2 * | 6/2017 | Berend | A43B 7/144 |
| 2003/0005600 | A1 * | 1/2003 | Kita | A43B 13/41 36/76 R |

(Continued)

FOREIGN PATENT DOCUMENTS

EP 3 563 709 A1 11/2019

OTHER PUBLICATIONS

International Search Report and Written Opinion, mailed Nov. 17, 2021, issued for International Application No. PCT/US2021/046332, 14 pages.

*Primary Examiner* — Khoa D Huynh
*Assistant Examiner* — Haley A Smith
(74) *Attorney, Agent, or Firm* — Klarquist Sparkman, LLP

(57) ABSTRACT

An article of footwear can include an upper and a sole structure. The upper defines at least a portion of a foot-receiving cavity. The sole structure is coupled to the upper and includes a midfoot support member. The midfoot support member includes a lateral flange, a medial flange, a superior deck plate, and an inferior deck plate. The superior deck plate and the inferior deck plate span from the lateral flange to the medial flange. The superior deck plate and the inferior deck plate are spaced apart in a superior/inferior direction and define an opening therebetween. The opening extends unobstructed from the lateral flange to the medial flange, and the lateral flange extends farther in a superior direction than the medial flange.

13 Claims, 5 Drawing Sheets

(56) References Cited

U.S. PATENT DOCUMENTS

| | | | | |
|---|---|---|---|---|
| 2006/0021251 | A1* | 2/2006 | Swigart | A43B 13/189 36/28 |
| 2008/0127526 | A1 | 6/2008 | Spicer et al. | |
| 2011/0302809 | A1* | 12/2011 | Kim | A43B 13/187 36/103 |
| 2015/0013185 | A1 | 1/2015 | Elder et al. | |
| 2016/0058123 | A1 | 3/2016 | Peyton | |
| 2019/0343223 | A1* | 11/2019 | Mason | A43B 13/12 |

* cited by examiner

MIDFOOT SUPPORT STRUCTURES FOR ARTICLES OF FOOTWEAR

CROSS-REFERENCE TO RELATED APPLICATION

This application claims priority to U.S. Provisional Application No. 63/068,540, filed Aug. 21, 2020, which is incorporated by reference herein.

FIELD

The present disclosure is directed to articles of footwear, and more particularly to midfoot support structures for articles of footwear.

BACKGROUND

An article of footwear (also referred to herein as "article") typically includes two main components: a sole structure and an upper. The sole structure is configured for supporting the wearer's foot and providing cushioning between the wearer's foot and the ground. The upper is coupled to the sole structure and is configured for securing the wearer's foot to the sole structure.

BRIEF DESCRIPTION

Aspects and advantages of the disclosed technology will be set forth in part in the following description, or may be obvious from the description, or may be learned through practice of the technology disclosed in the description.

Disclosed herein are articles of footwear that can provide, for example, controlled flexibility, improved strength, and/or increased support. In particular, the articles of footwear disclosed herein comprise a midfoot support structure that can provide localized support in areas of the article of footwear and/or the wearer's foot that are subjected to high forces (e.g., at the midfoot), while allowing other portions of the article of footwear to remain relatively more flexible for comfort and mobility (e.g., in the toe portion of the article of footwear).

In some examples, an article of footwear comprises an upper and a sole structure. The upper comprises a toe portion, a midfoot portion, and a heel portion. The sole structure is coupled to the upper so as to define a foot-receiving cavity therebetween. The sole structure comprises a lateral side, a medial side, a midsole, a midfoot support member, and an outsole. The midsole is disposed between the midfoot support member and the upper. The midfoot support member comprises a lateral flange, a medial flange, a first plate, and a second plate. The first plate spans from the lateral flange to the medial flange, and the second plate spans from the lateral flange to the medial flange. The lateral flange of the midfoot support member extends further in a superior direction than the medial flange of the midfoot support member. The second plate is disposed farther toward the outsole than the first plate, and the second plate is spaced apart from the first plate so as to form an opening extending through the midfoot support member from the lateral side of the sole structure to the medial side of the sole structure. The outsole is coupled to the midsole and the midfoot support member.

In certain examples, an article of footwear comprises an upper and a sole structure. The upper comprises a toe portion, a midfoot portion, and a heel portion. The sole structure is coupled to the upper so as to define a foot-receiving cavity therebetween. The sole structure comprises a lateral side, a medial side, a midsole, a midfoot support member, and an outsole. The midsole is disposed between the midfoot support member and the upper in a superior/inferior direction. The midfoot support member is aligned with the midfoot portion of the upper in an anterior/posterior direction and comprises a lateral plate, a medial plate, a first span member, and a second span member. The lateral plate is disposed on the lateral side of the sole structure, and the medial plate is disposed on the medial side of the sole structure. The lateral plate and the medial plate are spaced apart in a medial/lateral direction by the first span member and the second span member. The first span member is spaced apart from the second span member in the superior/inferior direction such that the first span member and the second span member define a gap therebetween. The gap extends from the lateral side of the sole structure to the medial side of the sole structure. The midsole comprises a midfoot flange that extends in a superior direction beyond the lateral plate of the midfoot support member, and the outsole is coupled to the midsole and the midfoot support member.

In particular examples, an article of footwear comprises an upper and a sole structure. The upper defines at least a portion of a foot-receiving cavity. The sole structure is coupled to the upper and comprises a midfoot support member. The midfoot support member comprises a lateral flange, a medial flange, a superior deck plate, and an inferior deck plate. The superior deck plate and the inferior deck plate span from the lateral flange to the medial flange. The superior deck plate and the inferior deck plate are spaced apart in a superior/inferior direction and define an opening therebetween. The opening extends unobstructed from the lateral flange to the medial flange, and the lateral flange extends farther in a superior direction than the medial flange.

In yet other examples, a midfoot support member for an article of footwear is provided. The midfoot support member comprises a lateral flange, a medial flange, a superior deck plate, and an inferior deck plate. The superior deck plate and the inferior deck plate span from the lateral flange to the medial flange. The superior deck plate and the inferior deck plate are spaced apart in a superior/inferior direction and define an opening therebetween. The opening extends unobstructed from the lateral flange to the medial flange, and the lateral flange extends farther in a superior direction than the medial flange.

These and other features, aspects, and/or advantages of the present disclosure will become better understood with reference to the following description and the claims. The accompanying drawings, which are incorporated in and constitute a part of this specification, illustrate examples of the disclosed technology and, together with the description, explain the principles of the disclosure.

DETAILED DESCRIPTION

General Considerations

Figure 1:
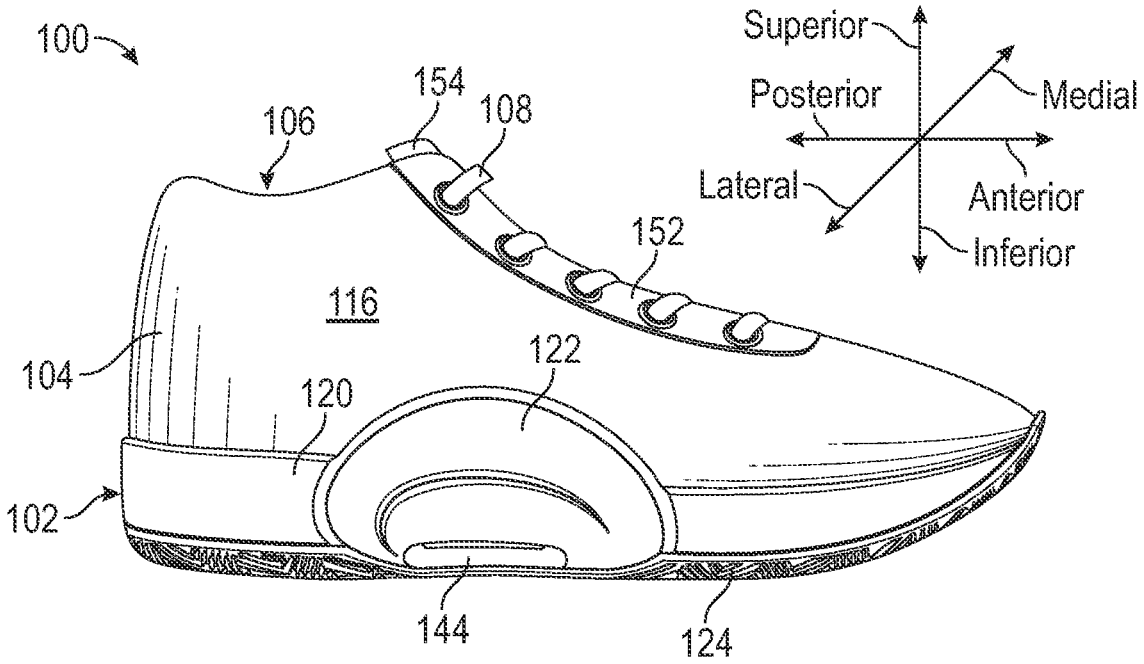
FIG. 1 depicts a lateral side view of an example of an article of footwear comprising a midfoot support structure.

The systems and methods described herein, and individual components thereof, should not be construed as being limited to the particular uses or systems described herein in any way. Instead, this disclosure is directed toward all novel and non-obvious features and aspects of the various disclosed examples, alone and in various combinations and subcombinations with one another. For example, any features or aspects of the disclosed examples can be used in various combinations and subcombinations with one another, as will be recognized by an ordinarily skilled artisan in the relevant field(s) in view of the information disclosed herein. In addition, the disclosed systems, methods, and components thereof are not limited to any specific aspect or feature or combinations thereof, nor do the disclosed things and methods require that any one or more specific advantages be present or problems be solved.

As used in this application, the singular forms "a," "an," and "the" include the plural forms unless the context clearly dictates otherwise. Additionally, the term "includes" means "comprises." Further, the terms "coupled" or "secured" encompass mechanical and chemical couplings, as well as other practical ways of coupling or linking items together, and do not exclude the presence of intermediate elements between the coupled items unless otherwise indicated, such as by referring to elements, or surfaces thereof, being "directly" coupled or secured. Furthermore, as used herein, the term "and/or" means any one item or combination of items in the phrase.

As used herein, the term "exemplary" means serving as a non-limiting example, instance, or illustration. As used herein, the terms "e.g.," and "for example," introduce a list of one or more non-limiting examples, instances, and/or illustrations.

Although the operations of some of the disclosed methods are described in a particular, sequential order for convenient presentation, this manner of description encompasses rearrangement, unless a particular ordering is required by specific language set forth below. For example, operations described sequentially may in some cases be rearranged or performed concurrently. Moreover, for the sake of simplicity, the attached figures may not depict the various ways in which the disclosed things and methods can be used in conjunction with other things and methods. Additionally, the description sometimes uses terms like "provide" and "produce" to describe the disclosed methods. These terms are high-level descriptions of the actual operations that are performed. The actual operations that correspond to these terms will vary depending on the particular implementation and are readily discernible by one of ordinary skill in the art having the benefit of this disclosure.

As used herein, the directional terms (e.g., "upper" and "lower") generally correspond to the orientation of an article of footwear or sole assembly as it is configured to be worn by a wearer. For example, an "upwardly-facing surface" and/or an "upper surface" of a sole assembly refers to the surface oriented in the "superior" anatomical direction (i.e., toward the head of a wearer) when the article of footwear is being worn by the wearer. Similarly, the directional terms "downwardly" and/or "lower" refer to the anatomical direction "inferior" (i.e., toward the ground and away from the head of the wearer). "Front" means "anterior" (e.g., towards the toes), and "rear" means "posterior" (e.g., towards the heel). "Medial" means "toward the midline of the body," and "lateral" means "away from the midline of the body." "Longitudinal axis" refers to a centerline of the article from the heel to toe. Similarly, a "longitudinal length" refers to a length of the article along the longitudinal axis and a "longitudinal direction" refers to a direction along the longitudinal axis.

As used herein, the term "sole structure" refers to any combination of materials that provides support for a wearer's foot and bears the surface that is in direct contact with the ground or playing surface, such as, for example, a single sole; a combination of an outsole and an inner sole; a combination of an outsole, a midsole, and an inner sole; and a combination of an outer covering, an outsole, a midsole and an inner sole.

As used herein, the terms "attached" and "coupled" generally mean physically connected or linked, which includes items that are directly attached/coupled and items that are attached/coupled with intermediate elements between the attached/coupled items, unless specifically stated to the contrary.

As used herein, the terms "fixedly attached" and "fixedly coupled" refer to two components joined in a manner such that the components may not be readily separated from one another without destroying and/or damaging one or both components. Exemplary modalities of fixed attachment may include joining with permanent adhesive, stitches, welding or other thermal bonding, and/or other joining techniques. In addition, two components may be "fixedly attached" or "fixedly coupled" by virtue of being integrally formed, for example, in a molding process. In contrast, the terms "removably attached" or "removably coupled" refer to two components joined in a manner such that the components can be readily separated from one another to return to their separate, discrete forms without destroying and/or damaging either component. Exemplary modalities of temporary attachment may include mating-type connections, releasable fasteners, removable stitches, and/or other temporary joining techniques.

As used herein, the terms "articles of footwear," "articles," and/or "footwear" mean any type of footwear, including, for example, casual shoes, walking shoes, sneakers, tennis shoes, running shoes, soccer shoes, football shoes, rugby shoes, basketball shoes, baseball shoes, boots, sandals, etc.

Although the figures may illustrate an article of footwear intended for use on only one foot (e.g., a right foot) of a wearer, one skilled in the art and having the benefit of this disclosure will recognize that a corresponding article of footwear for the other foot (e.g., a left foot) would be a mirror image of the right article of footwear.

Unless explained otherwise, all technical and scientific terms used herein have the same meaning as commonly understood to one of ordinary skill in the art to which this disclosure belongs. Although methods and materials similar or equivalent to those described herein can be used in the practice or testing of the present disclosure, suitable methods and materials are described below. The materials, methods, and examples are illustrative only and not intended to be limiting. Other features of the disclosure are apparent from the detailed description, abstract, and drawings.

Examples of the Disclosed Technology

An article of footwear typically includes two main components: a sole structure and an upper. The sole structure is configured for supporting the wearer's foot and providing cushioning between the wearer's foot and the ground. The upper is coupled to the sole structure and forms a foot-receiving cavity. The upper is configured for securing the wearer's foot to the sole structure and/or can protect the wearer's foot.

In use, a wearer's foot applies various forces to the sole structure and/or the upper. These forces can vary depending on the type of use and/or the physical characteristics (e.g., size, strength) of the wearer.

Typically, an upper of an article of footwear is made of one or more relatively thin, flexible materials. These materials allow the upper to bend and flex as the wearer moves and applies forces to the upper.

In some instances, it is desirable to allow one or more portions of the upper of an article to elastically deform (e.g., stretch) at least to some extent when forces are applied thereto. This can, for example, improve comfort. In other instances, it is desirable to limit or prevent one or more portions of the upper of the article from elastically deforming when forces are applied thereto. This can, for example, improve support and/or prevent the wearer's foot from slipping relative to the upper, the sole structure, and/or some other component of the article.

Due to the complex movements of a wearer's foot, it can be difficult to find the right balance of rigidity and stretchability. This difficulty is compounded in activities in which the wearer performs multiple types of movement. For example, when playing basketball, a wearer performs one or more complex movements, including running forward and backward, cutting side-to-side, jumping, pivoting, and stopping. Each of these movement exerts different types and magnitudes of forces on the article. Participants in other sports, such as tennis, soccer, football, baseball, volleyball, etc., move in similar but unique ways.

Thus, some shoes have an upper with rigidity/stretchability configured for one type of movement (e.g., running forward), but it may leave the upper too stretchable for other types of movement (e.g., cutting side-to-side, jumping, stopping, and/or accelerating). In some instances, the junction where the upper and the sole structure are secured together can be subject to relatively high forces when a wearer accelerates/decelerates and/or changes direction. This junction is sometimes referred to as "the bite line." Thus, articles of footwear with controlled flexibility, improved strength, and/or increased support are desired.

Disclosed herein are articles of footwear that can provide, for example, controlled flexibility, improved strength, and/or increased support. In particular, the articles of footwear disclosed herein comprise a midfoot support structure that can provide localized support in areas of the article of footwear and/or the wearer's foot that are subjected to high forces (e.g., at the midfoot), while allowing other portions of the article of footwear to remain relatively more flexible for comfort and mobility (e.g., in the toe portion of the article of footwear).

In some examples, the midfoot support structure can have a lateral side portion (i.e., corresponding to the lateral or outside of a wearer's foot) and a medial side portion (i.e., corresponding to the medial or inside of a wearer's foot). In some examples, the lateral side portion can extend "higher" (i.e., in the superior direction) than the medial side portion. This is due, at least in part, to the relatively higher forces that the lateral side of the article of footwear and/or the wearer's foot are subjected to (e.g., during lateral movements such as during a "crossover" or a "jump-stop" in a basketball activity). The relatively large lateral side portion of the midfoot support structure can distribute the forces across a larger area of the wearer's foot and/or away from the bite line seam of the sole structure and upper. This can, for example, improve the strength and/or comfort of the article of footwear disclosed herein compared to typical footwear.

In certain examples, an article of footwear can comprise a midfoot support structure with a lateral side portion and without a medial side portion. In other examples, an article of footwear can comprise a midfoot support structure with a medial side portion and without a lateral side portion.

A midfoot support structure can be a portion of the sole structure that is aligned with a midfoot region of the wearer's foot. The midfoot support structure can, in some instances, comprise portions of a midsole and a midfoot support member. In other examples, the midfoot support structure can include a midfoot support member. Additional details and examples are provided below and depicted in the accompanying drawings.

An article of footwear typically includes two main components: a sole structure and an upper. The sole structure is configured for supporting the wearer's foot and providing cushioning between the wearer's foot and the ground. The upper is coupled to the sole structure and forms a foot-receiving cavity. The upper is configured for securing the wearer's foot to the sole structure and/or can protect the wearer's foot.

Figure 2:
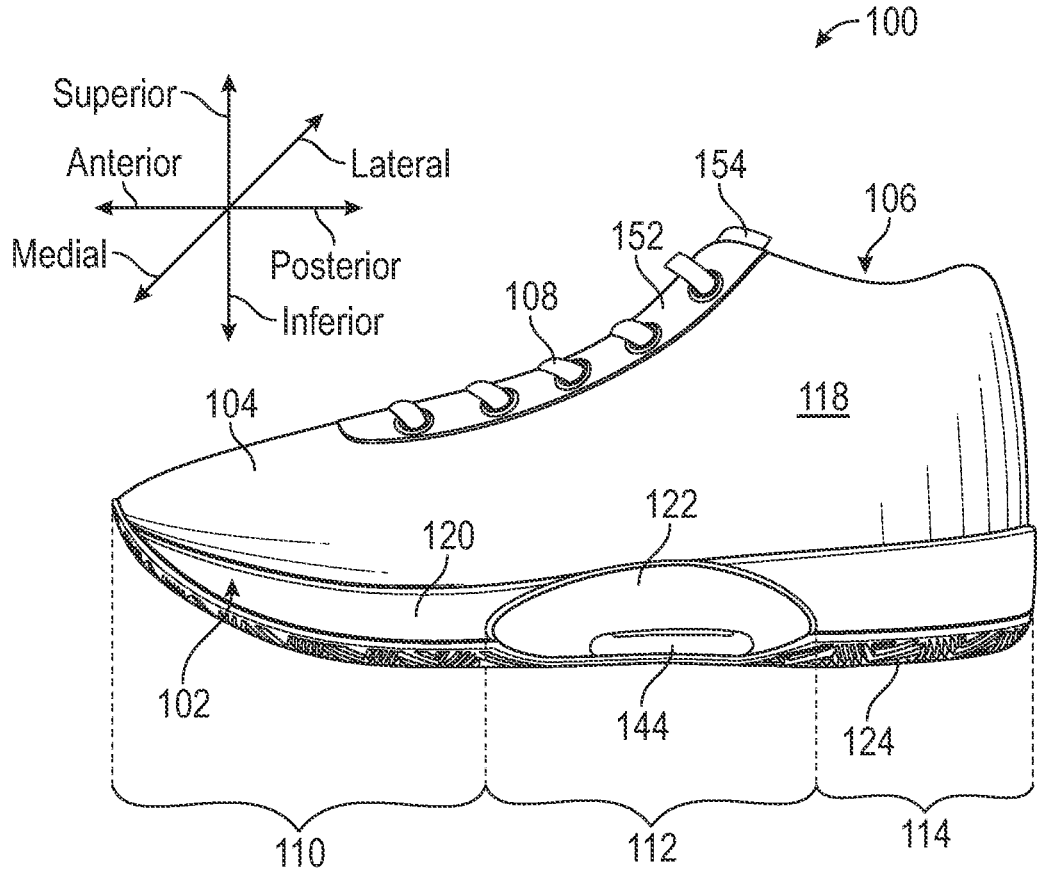
FIG. 2 depicts a medial side view of the article of footwear.

For example, FIGS. 1-2 depict an article of footwear 100, according to one example. The article of footwear 100 can also be referred to as "the article 100," "the footwear 100," or "the shoe 100." FIG. 1 depicts an elevation view of a lateral side of the article of footwear 100 (e.g., configured to be worn on a right foot of a wearer). FIG. 2 depicts an elevation view of a medial side of the article of footwear 100.

Referring to FIGS. 1-2, the article of footwear 100 comprises a sole structure 102 and an upper 104. The upper 104 is coupled to and extends from the sole structure 102 thereby forming a foot-receiving cavity 106 between the sole structure 102 and the upper 104. The article of footwear also includes a closure system 108 to adjust the foot-receiving cavity 106. In this manner, the closure system can be used, for example, to secure/release the article of footwear 100 to/from a wearer's foot. Exemplary closure systems include laces, straps, bands, cables, cords, ratcheting mechanisms, hook-and-loop, etc.

The article of footwear 100 can be divided into one or more portions (which can also be referred to as "zones," "regions," or "sections"). For example, referring to FIG. 2, in an anterior posterior direction, the article of footwear 100 (and/or its components) can be divided into (and/or include) a forefoot portion 110, a midfoot portion 112, and a heel portion 114. The forefoot portion 110 of the article of footwear 100 can correspond to anterior portions of a foot, including toes and joints connecting metatarsal bones with phalanx bones of the foot. The midfoot portion 112 of the article of footwear 100 can correspond with an arch area of the foot. The heel portion 114 of the article of footwear 100 can correspond with posterior portions of the foot, including a calcaneus bone.

In a medial/lateral direction, the article of footwear 100 (and/or its components) can be divided into a lateral side portion 116 and a medial side portion 118, both of which extend through the forefoot portion 110, the midfoot portion 112, and the heel portion 114. For example, FIG. 1 depicts the lateral side portion 116 of the article of footwear 100, and FIG. 2 depicts the medial side portion 118 of the article of footwear 100.

The article of footwear 100 can also be described in reference to a superior/inferior direction. For example, in the orientation depicted in FIGS. 1-2, the superior direction is up, and the inferior direction is down.

Figure 3:
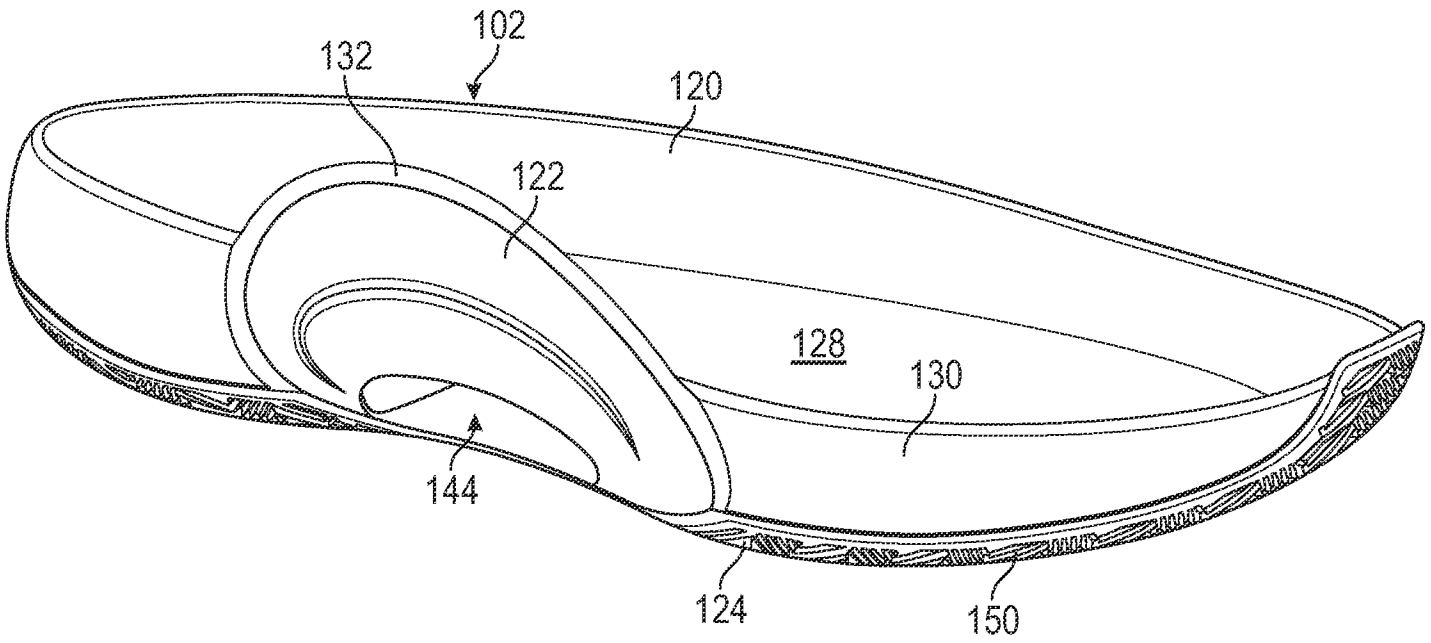
FIG. 3 depicts a perspective view of a sole structure of the article of footwear.
Figure 4:
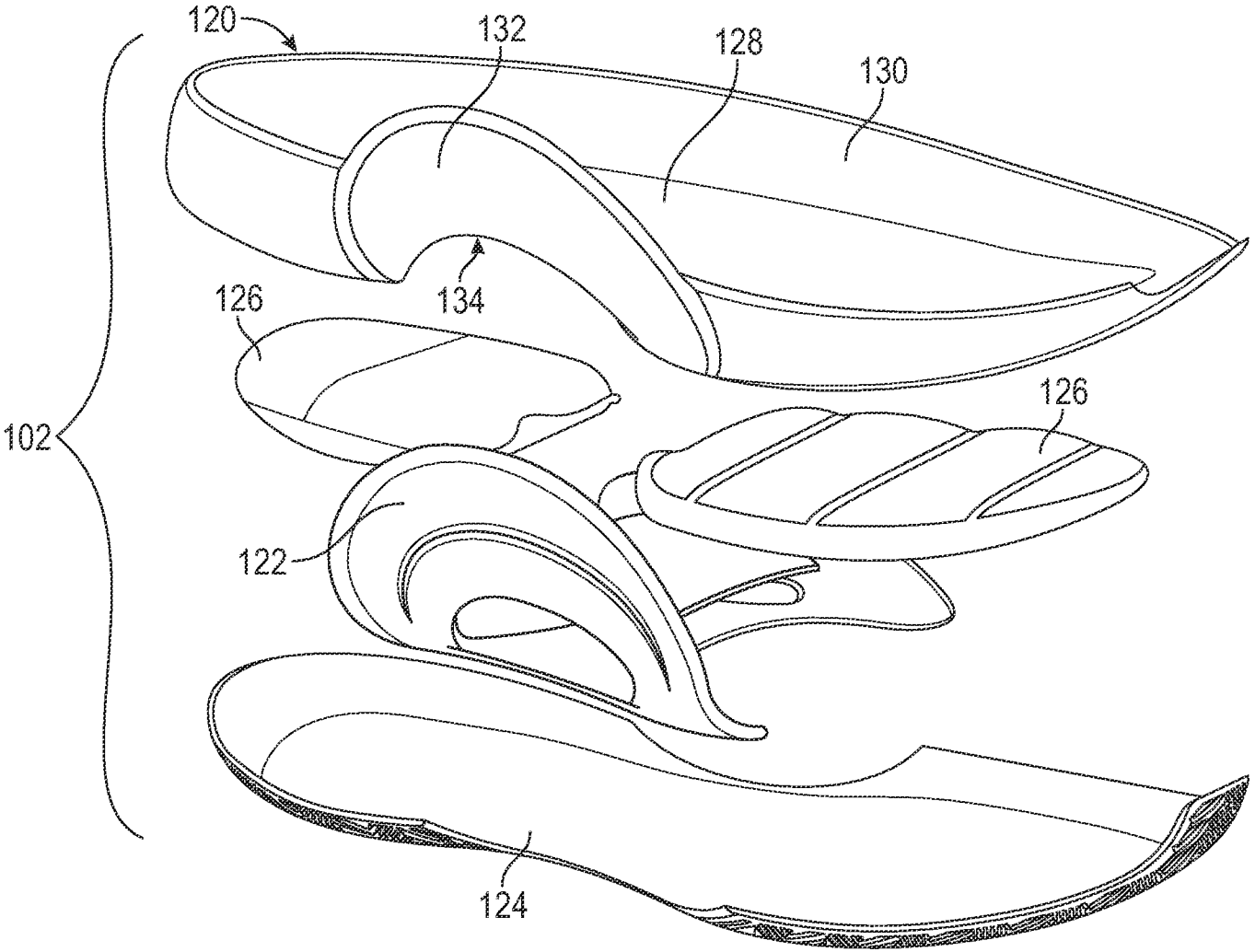
FIG. 4 depicts an exploded view of the sole structure of the article of footwear.

Referring now to FIGS. 3-4, the sole structure 102 of the article of footwear 100 comprises a midsole 120, a midfoot support member 122, and an outsole 124. FIG. 3 depicts the sole structure 102 in an assembled configuration. FIG. 4 depicts the sole structure in an exploded configuration and a plurality (e.g., two) of cushioning elements 126, which are optional.

The components of the sole structure 102 can be coupled together in various ways. For example, in some instances, the midsole 120, the midfoot support member 122, the outsole 124 and/or the cushioning elements 126 can be coupled together with adhesive, fasteners, stitching, overmolding, co-molding, and/or other means for coupling.

The sole structure 102 can be coupled to the upper 104 in various ways. For example, in some instances, the sole structure 102 and the upper can be coupled together with adhesive, fasteners, stitching, and/or other means for coupling. In certain examples, the article of footwear 100 can include a strobel that is coupled (e.g., sewn) to an inferior portion of the upper 104, and the strobel can be coupled to the midsole 120 (e.g., via adhesive).

The midsole 120 of the sole structure 102 is configured to be positioned under the wearer's foot. As such, the midsole 120 can, for example, be configured to provide cushioning and support. The midsole 120 can be configured to flex and/or elastically deform as the wearer's foot applies pressure upon the midsole 120 and/or as the article of footwear 100 impacts a ground surface. In some examples, the midsole 120 can comprise relatively flexible foam material.

Referring to FIG. 4, the midsole 120 can comprise a footbed 128, a rim 130, and a midfoot flange 132. The footbed 128 is configured to be disposed under the bottom of the wearer's foot to provide cushioning and support thereto. The rim 130 extends in a superior direction from the footbed 128 and around the perimeter of footbed 128. The rim 130 can be configured to extend over a portion of the upper 104 and extend onto the side of the wearer's foot. In this manner, the rim 130 of the midsole 120 can provide support to the side of the wearer's foot. The midfoot flange 132 extends in a superior direction beyond the footbed 128 the rim 130. As such, the midfoot flange 132 of the midsole 120 can provide support to the side of the wearer's foot.

In the illustrated example, the midfoot flange 132 is disposed on a lateral side of the midsole 120. Additionally or alternatively, the midsole 120 can comprise a midfoot flange on a medial side of the midsole 120. In some instances where the midsole comprises a midfoot flange on both the medial and lateral sides, the lateral flange can extend in a superior direction beyond the medial flange.

The midfoot flange 132 can comprise various shapes taken in a plane perpendicular to an anterior/posterior direction of the article of footwear 100. For example, the midfoot flange 132 comprises an arcuate or a semi-annular shape in the illustrated example. In other examples, the midfoot flange can be semi-circular, circular, elliptical, rectangular, triangular, trapezoidal, etc.

In some examples, the midsole 120 can comprise a recess 134 formed in the inferior surface of the midsole 120. The recess 134 can be aligned with the midfoot flange 132 such that the recess 134 is positioned under the arch of a wearer's foot. The recess 134 can also be configured to receive a portion of the midfoot support member 122, as further described below.

Figure 5:
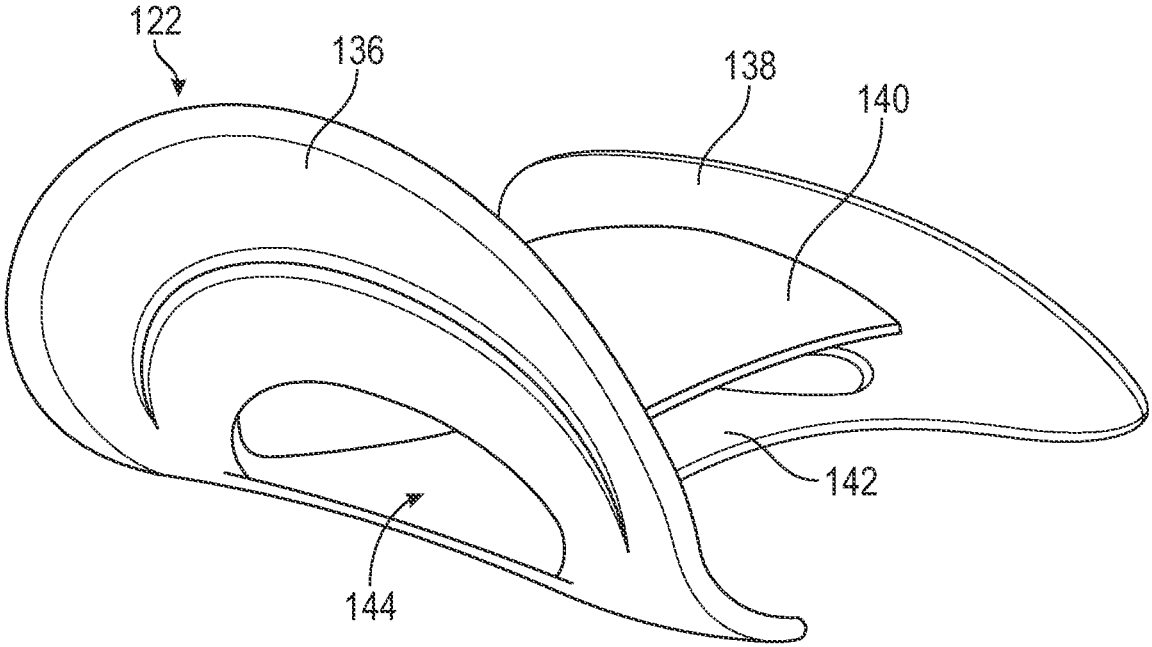
FIG. 5 depicts a perspective view of a midfoot support member of the article of footwear.
Figure 6:
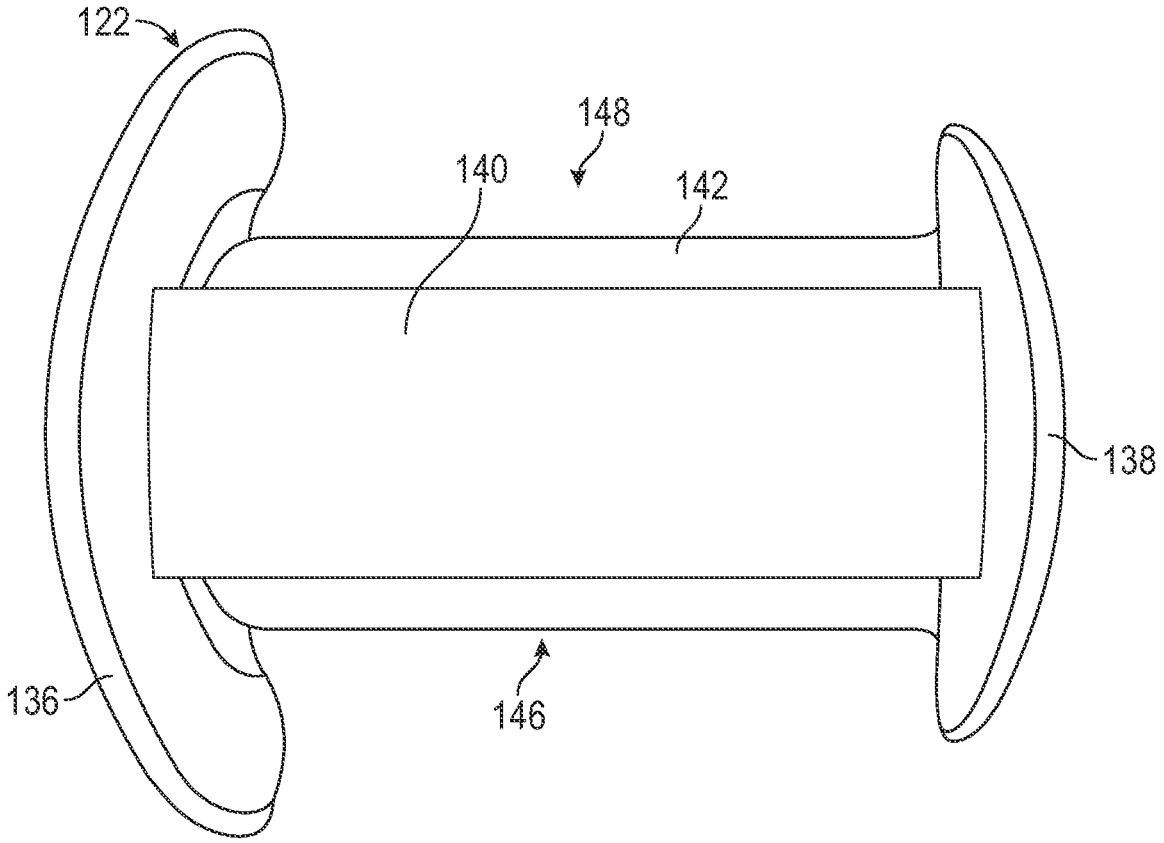
FIG. 6 depicts a top view of the midfoot support member of the article of footwear.
Figure 7:
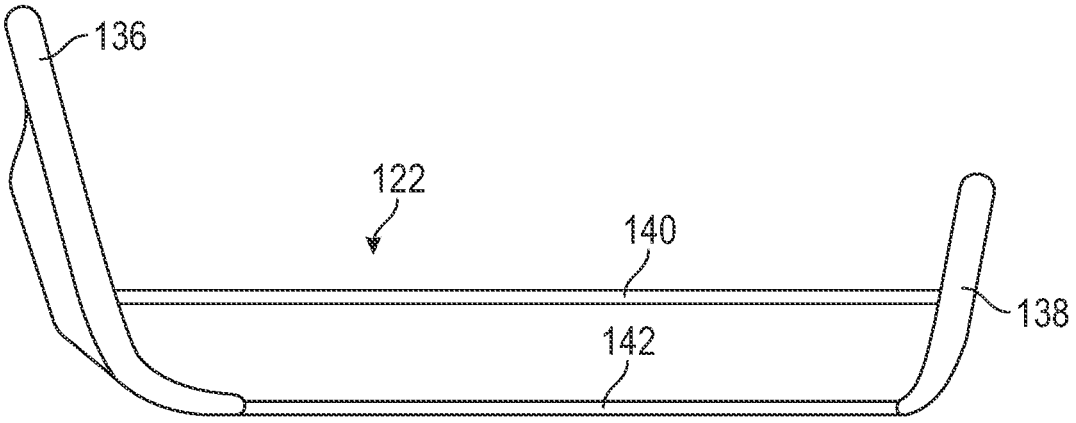
FIG. 7 depicts an end view of the midfoot support member of the article of footwear.

FIGS. 5-7 depict the midfoot support member 122. FIG. 5 is a perspective view of the midfoot support member 122 (primarily depicting the lateral side). FIG. 6 is a top view of the midfoot support member 122. FIG. 7 is an anterior end view of the midfoot support member 122.

The midfoot support member 122 can, for example, provide arch support to the bottom of the wearer's foot and/or can provide support to the side of the wearer's foot. The midfoot support member 122 can, in some examples, be formed of a relatively stiffer and/or harder material than the upper 104 and/or the midsole 120. For instance, in particular examples, the midfoot support member 122 can be formed of one or more polymeric materials such as thermoplastic polyurethane (TPU), polyamide (PA or nylon), polypropylene (PP), polyethylene (PE), acrylonitrile butadiene styrene (ABS), etc.

Referring to FIG. 5, the midfoot support member 122 comprises a lateral flange 136, a medial flange 138, a superior deck plate 140, and an inferior deck plate 142. As depicted in FIGS. 5-6, the superior deck plate 140 and the inferior deck plate 142 extend in a medial/lateral direction from the lateral flange 136 to the medial flange 138. As depicted in FIGS. 5 and 7, the superior deck plate 140 and the inferior deck plate 142 are spaced apart in the superior/inferior direction, thereby forming an opening 144 that extends from the lateral side of the midfoot support member 122 to the medial side of the midfoot support member 122 (see also FIGS. 1-2).

As depicted in FIG. 7, the lateral flange 136 of the midfoot support member 122 extends further in the superior direction than the medial flange 138 of the midfoot support member 122. In other examples, the medial flange 138 of the midfoot support member 122 extends further in the superior direction than the lateral flange 136 of the midfoot support member 122. In yet other examples, the lateral flange 136 and the medial flange 138 can extend to the same or at least substantially the same extent in the superior direction.

The lateral flange 136 and/or the medial flange 138 of the midfoot support member 122 can comprise various shapes taken in a plane perpendicular to the medial/lateral direction of the article of footwear 100. For example, the flanges of the midfoot support member 122 comprise an arcuate or a semi-annular shape, as depicted in FIGS. 1-2. In other examples, the flanges can be semi-circular, circular, elliptical, rectangular, triangular, trapezoidal, etc.

The lateral flange 136 and/or the medial flange 138 of the midfoot support member 122 can comprise various shapes taken in a plane perpendicular to the superior/inferior direction of the article of footwear 100. For example, as depicted in FIG. 6, the flanges of the midfoot support member 122 flare outward in the medial/lateral direction at intermediate portions relative to anterior and posterior portions (which may be referred to herein as "convex in the anterior/posterior direction"). In other examples, the flanges can flare inward in the medial/lateral direction at the intermediate portions relative to anterior and posterior portions (which may be referred to herein as "concave in the anterior/posterior direction"). In yet other examples, the flanges can be straight or at least substantially straight in the medial/lateral direction. In other examples still, the flanges can be angled or tapered such that anterior portions of the flanges extend farther in the medial/lateral direction than posterior portions of the flanges, or vice versa.

The lateral flange 136 and/or the medial flange 138 of the midfoot support member 122 can comprise various shapes taken in a plane perpendicular to the anterior/posterior direction of the article of footwear 100. For example, as depicted in FIG. 7, the lateral flange 136 of the midfoot support member 122 flares outward in the lateral direction at an intermediate portion relative to superior and inferior portions (which may be referred to herein as "convex in the superior/inferior direction"). In other examples, the flanges can flare inward in the medial/lateral direction at the intermediate portions relative to superior and inferior portions (which may be referred to herein as "concave in the superior/inferior direction"). As also depicted in FIG. 7, the medial flange 138 is angled or tapered outwardly in the medial direction such that the superior portion is disposed medial to the inferior portion. In other examples, the flanges can be angled or tapered such that inferior portions of the flanges extend farther in the medial/lateral direction than superior portions of the flanges. In yet other examples, the flanges can be straight or at least substantially straight in the superior/inferior direction (e.g., vertical).

The lateral flange 136 and the medial flange 138 can both comprise the same shape and/or size or can each comprise a different shape and/or size in the one or more planes and/or directions described above.

Referring now to FIGS. 5-7, the superior deck plate 140 and the inferior deck plate 142 of the midfoot support member 122 are spaced apart thereby forming the opening 144 between the plates, as mentioned above. The upper surface of the superior deck plate 140 can be positioned against and/or coupled to the lower surface of the midsole 120 in some examples. In certain examples, the midsole can comprise a recess or groove formed therein that is configured to receive the superior deck plate 140. The lower surface of the inferior deck plate 142 can be positioned against and/or coupled to the upper surface of the outsole 124. As such, the superior deck plate 140 can, for example, provide support to the arch of the wearer's foot, and the inferior deck plate 142 can support the outsole 124. The void between the superior deck plate 140 and the inferior deck plate 142 can, for example, reduce weight and/or consumption of materials.

Due to the spacing between the superior deck plate 140 and the inferior deck plate 142 and the arcuate shapes of the lateral flange 136 and the medial flange 138, the midfoot support member comprises the opening 144. In some examples, the opening 144 of the midfoot support member 122 is unobstructed from the lateral side portion 116 of the article of footwear 100 to the medial side portion 118 of the article of footwear 100, as depicted in FIGS. 1-2. In this manner, the opening 144 can, for example, provide improved aesthetics compared to a typical sole structure.

In certain examples, the opening 144 can be covered by a cover. The cover can, for example, prevent debris from entering the opening. In particular examples, the cover can be transparent or translucent such that it is still possible for visible light to pass through the opening 144 from one side of the article of footwear 100 to the other.

As depicted in FIG. 6, the superior deck plate 140 comprises a width in the anterior/posterior direction that is less than the width of the inferior deck plate 142. In other examples, the superior deck plate 140 can comprise a width in the anterior/posterior direction that is greater than the width of the inferior deck plate 142. In yet other examples, the superior deck plate 140 can comprise a width in the anterior/posterior direction that is the same or at least substantially the same as the width of the inferior deck plate 142.

In certain examples, the midfoot support member 122 comprises one or more mating elements configured to receiving one or more cushioning elements. For instance, in the illustrated example, the midfoot support member 122 comprises an anterior recess 146 and a posterior recess 148, which are configured for receiving the cushioning elements 126, as depicted in FIG. 4. The anterior edges of the deck plates and the interior surfaces of the flanges can define the anterior recess 146. The posterior edges of the deck plates and the interior surfaces of the flanges can define the posterior recess 148.

In some examples, the sole structure 102 can include one or more additional components. For instance, in the illustrated example, the sole structure 102 comprises a plurality of cushioning elements 126. Various types of cushioning elements can be used. For example, the cushioning elements 126 can be fluid-filled capsules (e.g., airbags). As another example, the cushioning elements 126 can be foam pads. As yet another example, the cushioning elements can include a plurality of bead-like members contained within a flexible membrane.

In particular implementations, the sole structure can include one or more additional components (e.g., one or more additional cushioning elements) and/or omit one or more of the components of the sole structure (e.g., there may only one cushioning element, or there may be no cushioning elements).

The outsole 124 of the sole structure 102 is configured to contact the ground surface. Accordingly, the outsole 124 can, for example, be configured to provide increased traction and/or to protect the other components of the sole structure 102 and/or the upper 104. In some examples, the outsole can comprise various traction elements (e.g., nubs, ribs, cleats, lugs, patterns, etc.) configured for engaging one or more types of ground surfaces. For example, as depicted in FIG. 3, the outsole 124 comprises a plurality of ribs 150 arranged in various orientations. This outsole configuration can be used, for example, on relatively hard and smooth surfaces such as a basketball court (e.g., hardwood, concrete, asphalt, etc.). For different applications (e.g., soft surfaces), the outsole can comprise cleats or lugs configured to engage and/or penetrate the ground surface (e.g., dirt or grass). In some examples, the outsole 124 can comprise one or more relatively flexible polymeric materials (e.g., thin rubber). In other examples, the outsole 124 can comprise one or more relatively rigid polymeric materials (e.g., TPU) and/or metallic materials (e.g., steel).

Referring to FIG. 1, the upper 104 comprises a throat portion 152 separating the lateral side of the upper 104 and the medial side of the upper 104. The upper 104 also comprises a tongue 154 disposed at least partially within the throat portion 152. In other examples, the upper 104 can be formed without a throat portion and/or a tongue.

The upper 104 of the footwear 100 can be formed of various materials. For example, the upper 104 can be formed of one or more of the following materials: textiles, foam, leather, polymers, and/or synthetic leather. In some examples, the upper 104 can be formed as a single, unitary component (e.g., by knitting or molding). In other examples, the upper 104 can comprise a plurality of components that are coupled together (e.g., by stitching, adhesive, fasteners, etc.).

The upper 104 can be fixedly coupled to the sole structure 102 in various ways. The upper 104 can be attached (e.g., stitched) to a strobel, and the strobel can be attached to the midsole 120 (e.g., with an adhesive). In other examples, the strobel can be omitted, and the upper 104 can be attached to a component of the sole structure 102. In some such examples, the upper 104 can be directly attached to the midsole 120 and/or a cushioning element (e.g., an airbag) of the sole structure 102 via adhesive, stitching, and/or other means for coupling.

The article of footwear 100 can, in some instances, further comprise a sockliner (which may also be referred to as "an insole"). The sockliner can be configured to be positioned directly underfoot and is configured to cushion and/or support the wearer's foot. The sockliner can comprise various materials including textile, leather, foam, and/or other types of materials.

It should also be noted that, although the articles of footwear depicted and/or described herein are primarily configured as basketball shoes, the disclosed articles of footwear and components thereof are suitable and/or can readily be adapted for use in various other sports. For example, the midfoot support members disclosed herein can be used with tennis shoes, soccer shoes, football shoes, rugby shoes, baseball shoes, etc.

Further aspects of the disclosure are provided by the subject matter of the following examples:

1. An article of footwear comprises an upper and a sole structure. The upper comprises a toe portion, a midfoot portion, and a heel portion. The sole structure is coupled to the upper so as to define a foot-receiving cavity therebetween. The sole structure comprises a lateral side, a medial side, a midsole, a midfoot support member, and an outsole. The midsole is disposed between the midfoot support member and the upper. The midfoot support member comprises a lateral flange, a medial flange, a first plate, and a second plate. The first plate spans from the lateral flange to the medial flange, and the second plate spans from the lateral flange to the medial flange. The lateral flange of the midfoot support member extends further in a superior direction than the medial flange of the midfoot support member. The second plate is disposed farther toward the outsole than the first plate, and the second plate is spaced apart from the first plate so as to form an opening extending through the midfoot support member from the lateral side of the sole structure to the medial side of the sole structure. The outsole is coupled to the midsole and the midfoot support member.

2. The article of footwear of any example herein, wherein the lateral flange of the midfoot support member comprises an arcuate shape extending from a first location disposed adjacent the outsole and toward the toe portion of the upper to a second location adjacent the outsole and toward the heel portion of the upper.

3. The article of footwear of any example herein, wherein the first location and the second location are disposed on either side of the opening extending through the midfoot support member.

4. The article of footwear of any example herein, wherein the medial flange of the midfoot support member comprises an arcuate shape extending from a third location disposed adjacent the outsole and toward the toe portion of the upper to a fourth location adjacent the outsole and toward the heel portion of the upper.

5. The article of footwear of any example herein, wherein the sole structure further comprises one or more cushioning elements disposed between the midsole and the outsole.

6. The article of footwear of any example herein, wherein the one or more cushioning elements comprises one or more fluid-filled chambers.

7. The article of footwear of any example herein, wherein the one or more cushioning elements includes a first cushioning element extending in an anterior direction from the midfoot support member.

8. The article of footwear of any example herein, wherein the one or more cushioning elements includes a second cushioning element extending in a posterior direction from the midfoot support member.

9. The article of footwear of any example herein, wherein the midfoot support member comprises an anterior recess and a posterior recess, wherein the anterior recess is configured to receive one of the one or more cushioning elements, and wherein the posterior recess is configured to receive another one of the one or more cushioning elements.

10. An article of footwear comprises an upper and a sole structure. The upper comprises a toe portion, a midfoot portion, and a heel portion. The sole structure is coupled to the upper so as to define a foot-receiving cavity therebetween. The sole structure comprises a lateral side, a medial side, a midsole, a midfoot support member, and an outsole. The midsole is disposed between the midfoot support member and the upper in a superior/inferior direction. The midfoot support member is aligned with the midfoot portion of the upper in an anterior/posterior direction and comprises a lateral plate, a medial plate, a first span member, and a second span member. The lateral plate is disposed on the lateral side of the sole structure, and the medial plate is disposed on the medial side of the sole structure. The lateral plate and the medial plate are spaced apart in a medial/lateral direction by the first span member and the second span member. The first span member is spaced apart from the second span member in the superior/inferior direction such that the first span member and the second span member define a gap therebetween. The gap extends from the lateral side of the sole structure to the medial side of the sole structure. The midsole comprises a midfoot flange that extends in a superior direction beyond the lateral plate of the midfoot support member, and the outsole is coupled to the midsole and the midfoot support member.

11. The article of footwear of any example herein, wherein the outsole is coupled to the second span member of the midfoot support member.

12. The article of footwear of any example herein, wherein the lateral plate of the midfoot support member comprises a semi-annular shape in a plane perpendicular to the medial/lateral direction.

13. The article of footwear of any example herein, wherein the medial plate of the midfoot support member comprises a semi-annular shape in a plane perpendicular to the medial/lateral direction.

14. The article of footwear of any example herein, wherein the lateral plate extends farther in a superior direction than the medial plate.

15. The article of footwear of any example herein, wherein the lateral plate of the midfoot support member is disposed lateral to the midfoot section of the midsole.

16. The article of footwear of any example herein, further comprising one or more cushioning elements disposed superior to the outsole and configured to be positioned inferior to a wearer's foot that is disposed in the foot-receiving cavity.

17. An article of footwear comprises an upper and a sole structure. The upper defines at least a portion of a foot-receiving cavity. The sole structure is coupled to the upper and comprises a midfoot support member. The midfoot support member comprises a lateral flange, a medial flange, a superior deck plate, and an inferior deck plate. The superior deck plate and the inferior deck plate span from the lateral flange to the medial flange. The superior deck plate and the inferior deck plate are spaced apart in a superior/inferior direction and define an opening therebetween. The opening extends unobstructed from the lateral flange to the medial flange, and the lateral flange extends farther in a superior direction than the medial flange.

18. The article of footwear of any example herein, wherein the sole structure further comprises a midsole and an outsole, wherein the midsole comprises a lateral plate disposed at a midfoot region, wherein the lateral plate of the midsole extends in the superior direction beyond the lateral flange of the midfoot support member.

19. The article of footwear of any example herein, wherein the midfoot support member comprises an anterior recess.

20. The article of footwear of any example herein, wherein the midfoot support member comprises a posterior recess.

21. The article of footwear of any example herein, further comprising a forefoot cushioning element disposed within the anterior recess of the midfoot support member.

22. The article of footwear of any example herein, further comprising a heel cushioning element disposed within the posterior recess of the midfoot support member.

23. The article of footwear of any example herein, wherein the sole structure further comprises a midsole and an outsole, and wherein the midfoot support member is disposed inferior to the midsole and superior to the outsole.

24. A midfoot support member for an article of footwear comprises a lateral flange, a medial flange, a superior deck plate, and an inferior deck plate. The superior deck plate and the inferior deck plate span from the lateral flange to the medial flange. The superior deck plate and the inferior deck plate are spaced apart in a superior/inferior direction and define an opening therebetween. The opening extends unobstructed from the lateral flange to the medial flange, and the lateral flange extends farther in a superior direction than the medial flange.

Any feature(s) of any example(s) disclosed herein can be combined with or isolated from any feature(s) of any example(s) disclosed herein, unless otherwise stated. For example, an article of footwear may comprise a midfoot support member disclosed herein (e.g., the midfoot support member 122—see FIGS. 5-7) in combination with another type of sole structure and/or upper.

In view of the many possible examples to which the principles of the disclosure may be applied, it should be recognized that the illustrated examples should not be taken as limiting the scope of the claims. Rather, the scope of the claimed subject matter is defined by the following claims and their equivalents.

The invention claimed is:

1. An article of footwear comprising:

an upper comprising a toe portion, a midfoot portion, and a heel portion; and a sole structure coupled to the upper so as to define a foot-receiving cavity therebetween, wherein the sole structure comprises a lateral side, a medial side, a midsole, a midfoot support member, and an outsole, wherein the midsole is disposed between the midfoot support member and the upper, wherein the midfoot support member comprises a lateral flange, a medial flange, a first plate, and a second plate, wherein the first plate is connected to and spans from the lateral flange to the medial flange, wherein the second plate is connected to and spans from the lateral flange to the medial flange, wherein the lateral flange of the midfoot support member extends further in a superior direction, an anterior direction, and a posterior direction than the medial flange of the midfoot support member, wherein the second plate is disposed farther toward the outsole than the first plate, and wherein the second plate is spaced apart from the first plate so as to form an opening extending through the midfoot support member from the lateral side of the sole structure to the medial side of the sole structure, wherein the lateral flange extends further in the anterior direction and the posterior direction than the second plate, wherein the medial flange extends further in the anterior direction and the posterior direction than the second plate, wherein the second plate extends further in the anterior direction and the posterior direction than the first plate, and wherein the outsole is coupled to the midsole and the midfoot support member.

2. The article of footwear of claim 1, wherein the lateral flange of the midfoot support member comprises an arcuate shape extending from a first location disposed adjacent the outsole and toward the toe portion of the upper to a second location adjacent the outsole and toward the heel portion of the upper.

3. The article of footwear of claim 2, wherein the first location and the second location are disposed on either side of the opening extending through the midfoot support member.

4. The article of footwear of claim 1, wherein the medial flange of the midfoot support member comprises an arcuate shape extending from a third location disposed adjacent the outsole and toward the toe portion of the upper to a fourth location adjacent the outsole and toward the heel portion of the upper.

5. The article of footwear of claim 1, wherein the sole structure further comprises one or more cushioning elements disposed between the midsole and the outsole.

6. The article of footwear of claim 5, wherein the one or more cushioning elements comprises one or more fluid-filled chambers.

7. The article of footwear of claim 5, wherein the one or more cushioning elements includes a first cushioning element extending in the anterior direction from the midfoot support member.

8. The article of footwear of claim 5, wherein the one or more cushioning elements includes a second cushioning element extending in the posterior direction from the midfoot support member.

9. The article of footwear of claim 5, wherein the midfoot support member comprises an anterior recess and a posterior recess, wherein one of the one or more cushioning elements is received in the anterior recess, and wherein another one of the one or more cushioning elements is received in the posterior recess.

10. An article of footwear comprising:

an upper defining at least a portion of a foot-receiving cavity; and a sole structure coupled to the upper and comprising a midfoot support member, wherein the midfoot support member comprises a lateral flange, a medial flange, a superior deck plate, and an inferior deck plate, wherein the superior deck plate and the inferior deck plate are each coupled to the lateral flange and to the medial flange and span from the lateral flange to the medial flange, wherein the superior deck plate and the inferior deck plate are spaced apart in a superior/inferior direction and define an opening therebetween, wherein the opening extends unobstructed from the lateral flange to the medial flange, wherein the lateral flange extends farther in a superior direction, an anterior direction, and a posterior direction than the medial flange, and wherein the inferior deck plate extends farther in the anterior direction and the posterior direction than the superior deck plate.

11. The article of footwear of claim 10, wherein the sole structure further comprises a midsole and an outsole, wherein the midsole comprises a lateral plate disposed at a midfoot region, wherein the lateral plate of the midsole extends in the superior direction beyond the lateral flange of the midfoot support member.

12. The article of footwear of claim 10, wherein the midfoot support member comprises an anterior recess.

13. The article of footwear of claim 10, wherein the midfoot support member comprises a posterior recess.

* * * * *